US007567039B2

(12) United States Patent
Shinmen et al.

(10) Patent No.: US 7,567,039 B2
(45) **Date of Patent: *Jul. 28, 2009**

(54) MULTIPLE DISCHARGE LAMP LIGHTING APPARATUS

(75) Inventors: Hiroshi Shinmen, Kitasaku-gun (JP); Robert Weger, Wels (AT)

(73) Assignee: Minebea Co., Ltd., Kitasaku-gun (JP)

( * ) Notice: Subject to any disclaimer, the term of this patent is extended or adjusted under 35 U.S.C. 154(b) by 125 days.

This patent is subject to a terminal disclaimer.

(21) Appl. No.: 11/791,545

(22) PCT Filed: Dec. 16, 2005

(86) PCT No.: PCT/JP2005/023159

§ 371 (c)(1),
(2), (4) Date: May 24, 2007

(87) PCT Pub. No.: WO2006/068054

PCT Pub. Date: Jun. 29, 2006

(65) Prior Publication Data

US 2008/0129218 A1 Jun. 5, 2008

(30) Foreign Application Priority Data

Dec. 24, 2004 (JP) ..... 2004-374097

(51) Int. Cl.
*H05B 41/24* (2006.01)

(52) U.S. Cl. ..... 315/224; 315/276; 315/277; 315/213

(58) Field of Classification Search ..... 315/244, 315/227 R, 294, 195, 86, 70, 7, 175, 243, 315/310, 254, 172, 58, 274, 101, 228, 290, 315/221, 189, 238, 272, 119, 212, 312, 225, 315/223, 205, 127, 200 R, 255; 363/16, 363/37, 131, 97, 23, 132, 56.05, 98; 307/9.1, 307/64, 10.1, 112, 326
See application file for complete search history.

(56) References Cited

U.S. PATENT DOCUMENTS 4,441,055 A * 4/1984 Balchjunas et al. ..... 315/288
2003/0001524 A1 1/2003 Lin et al.

(Continued)

FOREIGN PATENT DOCUMENTS

EP 1 542 347 A1 6/2005

(Continued)

*Primary Examiner*—Douglas W Owens
*Assistant Examiner*—Jae K Kim
(74) *Attorney, Agent, or Firm*—Oliff & Berridge, PLC

(57) ABSTRACT

A multiple discharge lamp lighting apparatus is provided which achieves stable and uniform lamp currents in a plurality of discharge lamps without a ballast element at the secondary side of an inverter transformer. The multiple discharge lamp lighting apparatus includes an inverter, and a plurality of inverter transformers each of which has a discharge lamp connected at a secondary winding thereof. A balance inductance element is provided between the primary side wirings of any adjacent pair of the plurality of inverter transformers. Each of the inverter transformers includes a tight coupling section and a loose coupling section, which function as a balance coil and an impedance element, respectively, whereby the lamp currents of the discharge lamps are stabilized and equalized without using a high withstand voltage element.

1 Claim, 6 Drawing Sheets

U.S. PATENT DOCUMENTS

| | | | |
|---|---|---|---|
| 2003/0141829 | A1 | 7/2003 | Yu et al. |
| 2004/0066151 | A1 | 4/2004 | Kang et al. |
| 2004/0155596 | A1 | 8/2004 | Ushijima et al. |

FOREIGN PATENT DOCUMENTS

| | | |
|---|---|---|
| JP | A 63-105498 | 5/1988 |
| JP | A 07-045393 | 2/1995 |
| JP | A 2000-181384 | 6/2000 |
| JP | B2 3256992 | 12/2001 |
| JP | A 2002-175891 | 6/2002 |
| JP | A 2003-031383 | 1/2003 |
| JP | A 2004-127929 | 4/2004 |
| JP | A 2004-335443 | 11/2004 |
| WO | WO 2004/017508 A1 | 2/2004 |

* cited by examiner

MULTIPLE DISCHARGE LAMP LIGHTING APPARATUS

BACKGROUND OF THE INVENTION

1. Field of the Invention

The present invention relates to a lamp lighting apparatus to drive a plurality of discharge lamps (multiple discharge lamp lighting apparatus), and particularly to a multiple discharge lamp lighting apparatus to drive cold cathode lamps or the like used as a light source of a backlight system for a liquid crystal display device.

2. Description of the Related Art

A discharge lamp, for example, a cold cathode lamp, is extensively used as a light source of a backlight system for a liquid crystal display (LCD) device, and such a discharge lamp is usually AC driven by a discharge lamp lighting apparatus provided with an inverter. Recently, as an LCD device becomes larger in size for a higher brightness, a multiple lamp backlight device adapted to drive a plurality of discharge lamps is more and more used as a lighting source for an LCD device.

Generally, a high voltage is required for driving a discharge lamp, and therefore a discharge lamp lighting apparatus usually includes an inverter transformer to generate a high voltage at the secondary side. An inverter means to generate a high frequency voltage is provided at the primary side of the inverter transformer, while a discharge lamp having a negative resistance characteristic, and a so-called ballast element, such as a ballast capacitor, to stabilize the lamp current of the discharge lamp are provided at the secondary side of the inverter transformer. In a conventional multiple discharge lamp lighting apparatus to drive a plurality of discharge lamps, a ballast capacitor is connected to each of the discharge lamps (refer to, for example, Patent Document 1).

A multiple discharge lamp lighting apparatus is required to provide a uniform lamp current for all discharge lamps in order to achieve a uniform brightness among all the discharge lamps. However, if an individual ballast capacitor is connected to each of the plurality of discharge lamps, the characteristics variation among the individual ballast capacitors may possibly cause lamp current variation among the discharge lamps. To cope with this variation problem, a multiple discharge lamp lighting apparatus is disclosed which includes a circuitry in which a balance coil is provided at the secondary side of an inverter thereby uniformizing the lamp currents of all the discharge lamps (refer to, for example, Patent Document 2). Also, another multiple discharge lamp lighting apparatus is disclosed which includes a circuitry in which electric power is supplied from a low voltage constant current source provided at the primary side of an inverter thereby eliminating requirement of a ballast capacitor (refer to, for example, Patent Document 3), and this circuitry is expected to have a certain effect on achieving a uniform lamp current for the plurality of discharge lamps.

Patent Document 1: Japanese Patent Application Laid-Open No. 2002-175891

Patent Document 2: Japanese Patent Application Laid-Open No. H7-45393

Patent Document 3: Japanese Patent No. 3256992

DISCLOSURE OF THE INVENTION

Problems to be Solved by the Invention

However, the multiple discharge lamp lighting apparatuses described above are accompanied with the following problems.

The multiple discharge lamp lighting apparatus disclosed in Patent Document 1 encounters, in addition to the aforementioned lamp current variation, a problem that an output voltage including the voltage drop of the ballast capacitor connected in series to the discharge lamp must be generated at the secondary side, which causes an increase in the dimension of the inverter transformer thus hindering downsizing of the apparatus.

Also, the multiple discharge lamp lighting apparatus disclosed in Patent Document 2 faces a problem that the balance coil provided at the secondary side is required to have a large inductance and so must be constituted by a large-size element thus inviting an increase in cost and a difficulty in downsizing.

And, the multiple discharge lamp lighting apparatus disclosed in Patent Document 3 may be free from the problems described above but has the following problem with its circuitry. Since a discharge lamp lighting apparatus, when used as a backlight for an LCD device, usually shares a power supply, specifically a constant voltage power supply, with a liquid crystal drive circuit, and the like, provision of a constant current source for the discharge lamp lighting apparatus results in adding an extra component to the entire assembly device thus increasing the total cost.

The present invention has been made in light of the problems described above, and it is an object of the present invention to provide a multiple discharge lamp lighting apparatus in which the lamp currents of a plurality of discharge lamps are stabilized and uniformed inexpensively without providing a ballast capacitor at the secondary side of an inverter transformer.

Means for Solving the Problems

In order to achieve the object described above, according to an aspect of the present invention, a multiple discharge lamp lighting apparatus to drive a plurality of discharge lamps is provided, which includes an inverter means to output a high frequency voltage, and a plurality of inverter transformers each having a discharge lamp connected at the secondary side thereof. The multiple discharge lamp lighting apparatus described above further includes a plurality of balance inductance elements each of which includes a tight coupling section and a loose coupling section, and each of which is disposed between primary side wirings of adjacent two of the plurality of inverter transformers.

In the aspect of the present invention, the tight coupling section and the loose coupling section of the balance inductance element may be constituted respectively by a tight coupling section and a loose coupling section of a pair of windings disposed around a magnetic core forming an open magnetic path, and the pair of windings may be connected in series to respective primary side wirings of the two adjacent inverter transformers.

Effect of the Invention

In the multiple discharge lamp lighting apparatus according to the present invention, a balance inductance element including a tight coupling section and a loose coupling section is disposed between the primary wirings of two adjacent inverter transformers, thereby stabilizing and equalizing the lamp currents of discharge lamps without a ballast element connected at the secondary side and without increasing the number of constituent members.

In the multiple discharge lamp lighting apparatus according to the present invention, since the loose coupling portion of the balance inductance element functions as a ballast impedance element and is connected at the primary winding of the inverter transformer, the inductance value can be reduced compared with a case when a inductance element as a ballast impedance element is connected at the secondary side, thus enabling downsizing of a ballast impedance element. Also, since high order harmonic component can be reduced by inductance at the primary side, the waveform of input applied to the inverter transformer can be denoised thus reducing heat generation due to the harmonic component, and consequently heat generation at the transformer can be reduced as a whole.

Further, in the multiple discharge lamp lighting apparatus according to the present invention, since the tight coupling section of the balance inductance element functions as a balance coil, currents flowing in the primary windings of the inverter transformers can be equalized without regard to the variation of the ballast impedance elements connected at the primary windings. Also, since each discharge lamp is connected at the secondary winding of the inverter transformer without a ballast element provided therebetween, the output power of the inverter transformer can be reduced, and the lamp current of each discharge lamp can be freed from the influence due to the characteristics variation of a ballast element, thus achieving a uniform lamp current among the discharge lamps. And, the inductance of a balance oil provided at the primary side of the inverter transformer can be reduced compared to when provided at the secondary side for equalizing the lamp currents, thus enabling downsizing of the element.

Accordingly, in the multiple discharge lamp lighting apparatus according to the present invention, since the ballast impedance element and the balance coil provided at the primary side of the inverter transformer can be integrally structured as one balance inductance element including the tight coupling section and the loose coupling section, the number of constituent members can be reduced compared to when the ballast impedance element and the balance coil are provided as separate members.

And, in the multiple discharge lamp lighting apparatus according to the present invention, since the balance inductance element is provided at the primary side of the inverter transformer, rather than at the secondary side to which a high voltage is applied, an element with a high withstand voltage is not necessary, the cost of constituent members can be reduced, and at the same time the malfunction and the fire hazard due to the insulation breakdown of the element is reduced enhancing the safety of the apparatus. Also, even when a short circuit (layer short) occurs in a winding of the secondary side of the inverter transformer, an excessive current flowing in the winding can be suppressed by the ballast impedance element provided at the primary side, thus preventing the inverter transformer from fuming and firing.

BEST MODE FOR CARRYING OUT THE INVENTION

Exemplary embodiments of the present invention will hereinafter be described with reference to the accompanying drawings.

Figure 1:
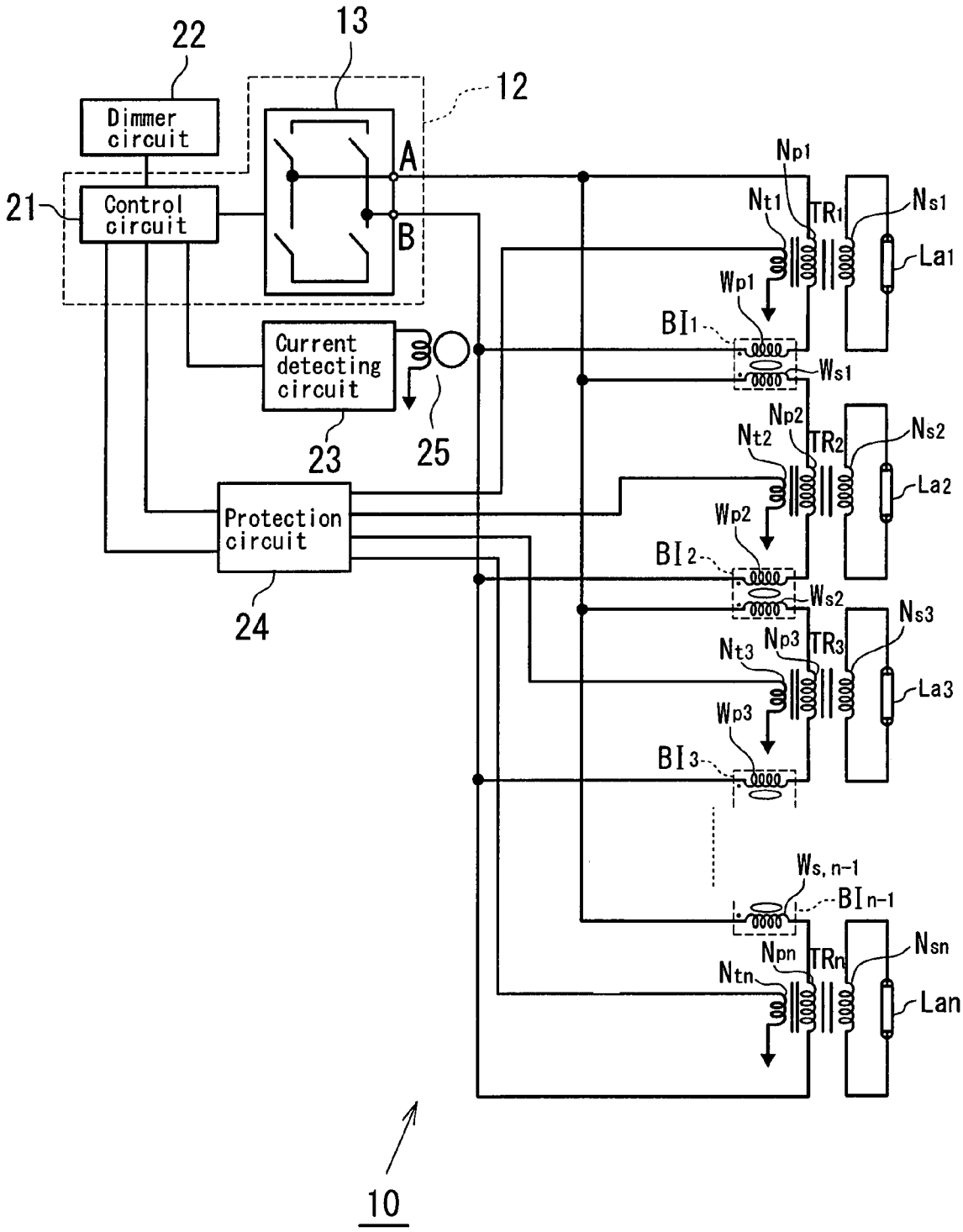
FIG. 1 is a circuit diagram of a multiple discharge lamp lighting apparatus according to a first embodiment of the present invention.

A first embodiment of the present invention will be described with reference to FIGS. 1 to 4. Referring to FIG. 1, a multiple discharge lamp lighting apparatus 10 according to the first embodiment drives a plurality (n units) of discharge lamps $La_1$ to $La_n$ and generally includes an inverter means 12, and a plurality (n units) of inverter transformers $TR_1$ to $TR_n$. The aforementioned discharge lamps $La_1$ to $La_n$, for example cold cathode lamps, are connected directly to respective secondary windings Ns1 to Nsn of the inverter transformers $TR_1$ to $TR_n$ without ballast elements provided therebetween, and the inverter transformers $TR_1$ to $TR_n$ are each connected in parallel to a switch means 13 included in the inverter means 12. The multiple discharge lamp lighting apparatus 10 further includes a balance inductance element $BI_i$ (i=1, 2, . . . , n−1) provided between respective one primary side wirings of two adjacent inverter transformers $TR_i$ and $TR_{i+1}$ out of the inverter transformers $TR_1$ to $TR_n$.

Figure 2:
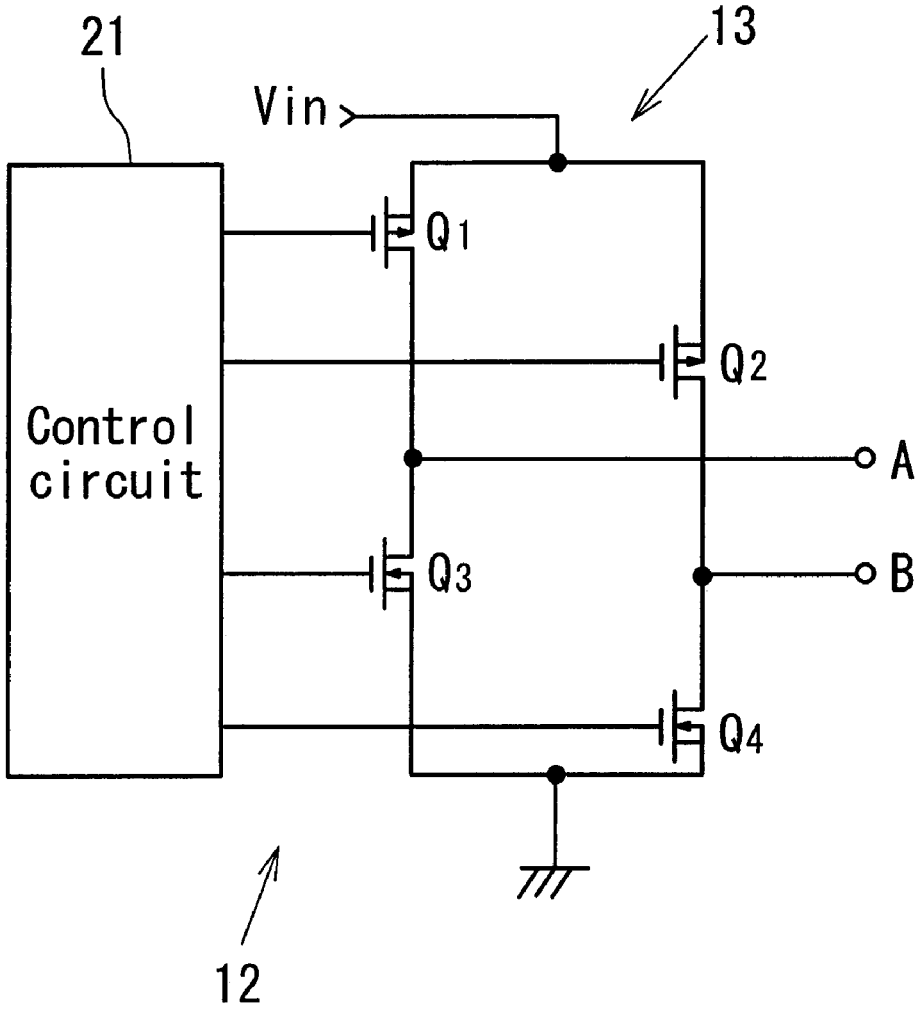
FIG. 2 is a circuit diagram of an inverter means of the multiple discharge lamp lighting apparatus of FIG. 1.

The inverter means 12 includes a full bridge circuit constituting the aforementioned switch means 13 (switch means 13 may hereinafter be referred to as full bridge circuit 13 as appropriate), and a control circuit 21 to drive the full bridge circuit 13. Referring to FIG. 2, the full bridge circuit 13 is structured such that a pair of switching elements Q1+Q3 connected in series to each other are connected in parallel to a pair of switching elements Q2+Q4 connected in series to each other, wherein, for example, the switching elements Q1 and Q2 are constituted by PMOSFET, and the switching elements Q3 and Q4 are constituted by NMOSFET. The inverter means 12 alternately repeats turning on and off two groups of the switching elements ("Q1+Q4" and "Q2+Q3") at a predetermined frequency (about 60 kHz, for example) according to the gate voltage outputted from the control circuit 21, thereby converting a DC voltage Vin into a high frequency voltage and then outputting at its output terminals A and B.

The balance inductance element $BI_i$ includes a pair of windings, specifically a primary winding Wpi and a secondary winding Wsi, and a magnetic core around which the primary and secondary windings Wpi and Wsi are disposed. The structure and operation of the balance inductance element $BI_i$ will be detailed later.

The inverter transformers $TR_i$ to $TR_n$, which are connected in parallel to the switch means 13, have the following connection mode. For example, as to the connection of the inverter transformer $TR_2$, one terminal of a primary winding Np2 of the inverter transformer $TR_2$ is connected in series to one terminal of a secondary winding Ws1 of a balance inductance element $BI_1$, with the other terminal of the secondary winding Ws1 connected to the output terminal A of the inverter means 12, while the other terminal of the primary winding Np2 of the inverter transformer $TR_2$ is connected to one terminal of a primary winding Wp2 of a balance inductance element $BI_2$, with the other terminal of the primary winding Wp2 connected to the output terminal B of the inverter means 12. The inverter transformers $TR_3$ to $TR_{n-1}$ are connected in the same way as the inverter transformer $TR_2$, though not entirely illustrated. As to the inverter transformers $TR_1$ and $TR_n$, since the inverter transformer $TR_1$ has its primary side wiring connected to the primary side wiring of the inverter transformer $TR_2$ alone, one terminal of a primary winding Np1 of the inverter transformer $TR_1$ is connected directly to the output terminal A of the inverter means 12, and since the inverter transformer $TR_n$ has its primary side wiring connected to the primary side wiring of the inverter transformer $TR_{n-1}$ alone, one terminal of a primary winding Npn of the inverter transformer $TR_n$ is connected directly to the output terminal B of the inverter means 12.

Referring back to FIG. 1, the multiple discharge lamp lighting apparatus 10 includes, in addition to the constituent members described above, a dimmer circuit 22, a current detecting circuit 23, and a protection circuit 24. While the present invention is feasible without regard to the use of these circuits 22, 23 and 24, a brief description will be made on the circuits 22, 23 and 24 as follows.

The current detecting circuit 23 generates an adequate signal according to the value of a current detected by a current transformer 25 and outputs the signal to the control circuit 21, which then, according to the signal, varies the on-duty of the switching elements Q1 to Q4 of the inverter means 12, thereby regulating the electric power applied to the inverter transformers $TR_1$ to $TR_n$. The protection circuit 24 generates an adequate signal according to the value of a voltage detected by tertiary windings Nt1 to Ntn of the inverter transformers $TR_1$ and $TR_n$ and outputs the signal to the control circuit 21, which then deactivates the inverter means 12 according to the signal when a malfunction, for example, an open circuit or a short circuit at the discharge lamps $La_1$ to $La_n$, is detected, thereby protecting the device associated. The dimmer circuit 22 outputs a signal to modulate the brightness of the discharge lamp La by, for example, burst dimming, to the control circuit 21, which then, according to the signal, activates intermittently the inverter means 12 at a frequency, for example, 150 to 300 Hz, thereby averaging the brightness of the discharge lamps $La_1$ to $La_n$. The current detecting circuit 23 detects a current at the current transformer 25 in the embodiment shown, but may alternatively be adapted to detect a lamp current at the discharge lamp La.

The structure and operation of the balance inductance elements $BI_1$ to $BI_{n-1}$ in the present embodiment will now be described with reference to FIGS. 3(*a*), 3(*b*) and 4. While the description to follow below refers mainly to the balance inductance element $BI_1$ provided between the primary side wiring of the inverter transformer $TR_1$ and the primary side wiring of the inverter transformer $TR_2$, the other balance inductance elements $BI_2$ to $BI_{n-1}$ have the same structure and operation.

Figure 3A:
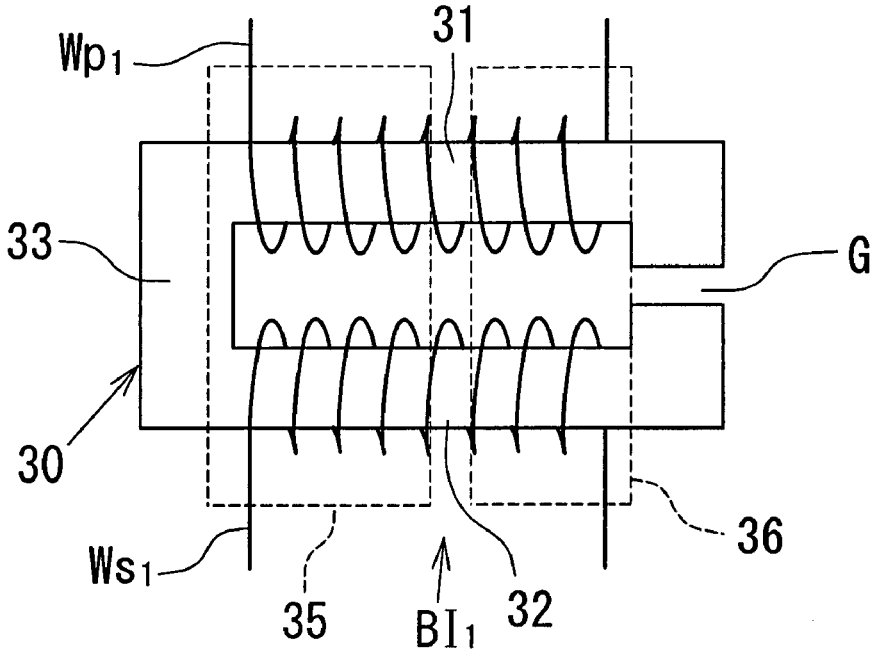
FIG. 3(*a*) is a schematic plan view of a balance inductance element of the multiple discharge lamp lighting apparatus of FIG. 1, and FIG. 3(*b*) is an equivalent circuit diagram of FIG. 3(*a*)
Figure 3B:
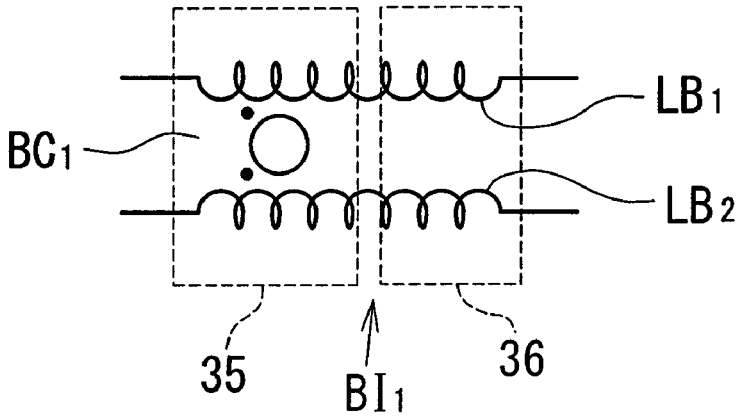

FIG. 3(*a*) is a schematic top plan view of the balance inductance element $BI_1$, and FIG. 3(*b*) is an equivalent circuit diagram thereof. Referring to FIG. 3(*a*), the balance inductance element $BI_1$ includes a magnetic core 30 configured in a squared-C, which is composed of two leg portions 31 and 32, and a bridge portion 33 to connect respective one ends of the leg portions 31 and 32, where a gap G is provided between respective other ends of the leg portions 31 and 32 thus forming an open magnetic path. The balance inductance element $BI_1$ also includes a primary winding Wp1 disposed around the leg portion 31, and the aforementioned secondary winding Ws1 having the same turn number as the primary winding Wp1 and disposed around the leg portion 32. The balance inductance element $BI_1$ structured as above is functionwise divided into a tight coupling section 35 located toward the bridge portion 33 where the primary and secondary windings Wp1 and Ws1 are tightly coupled to each other, and a loose coupling section 36 located toward the gap G where the primary and secondary windings Wp1 and Ws1 are loosely coupled to each other. Thus, the balance inductance element $BI_1$ functions as an element which is composed, as shown in FIG. 3(*b*), such that a balance coil $BC_1$ formed by the tight coupling section 35 is connected in series to each of inductors $LB_1$ and $LB_2$ which are formed respectively at the primary and secondary windings Wp1 and Ws1 by means of leakage inductance generated at the loose coupling section 36.

The magnetic core constituting the balance inductance element $BI_1$ of the present invention is not limited in configuration to the squared-C shown in FIG. 3(*a*) but may be arbitrarily configured, provided that an open magnetic path is formed so that a pair of windings are magnetically coupled to each other so as to provide tight and loose coupling sections.

Figure 4:
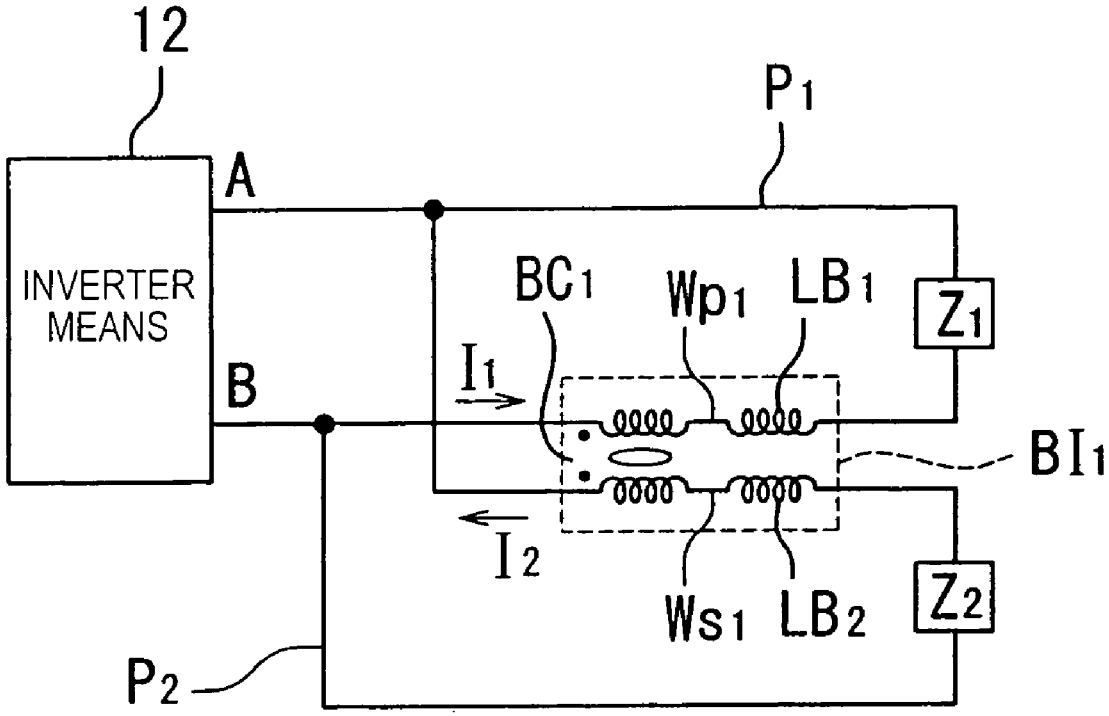
FIG. 4 is a circuit diagram of a key portion relevant to an operation of a balance inductance element of the multiple discharge lamp lighting apparatus of FIG. 1.

FIG. 4 is a circuit diagram of relevant portions of respective primary wirings $P_1$ and $P_2$ of the inverter transformers $TR_1$ and $TR_2$ in the multiple discharge lamp lighting apparatus 10 of FIG. 1. $Z_1$ and $Z_2$ shown in FIG. 4 represent impedances of other circuit elements than the balance inductance element $BI_1$, that are connected or deemed as connected respectively to the primary wirings $P_1$ and $P_2$, and include respective equivalent resistances of the discharge lamps $La_1$ and $La_2$ seen from the primary sides of the inverter transformers $TR_1$ and $TR_2$, and the like.

Currents $I_1$ and $I_2$ flow respectively in the primary and secondary windings Wp1 and Ws1 in the directions opposite to each other as shown in FIG. 4, where the balance coil $BC_1$ of the balance inductance element $BI_1$ functions to make the currents $I_1$ and $I_2$ equilibrate with each other so as to reduce $\Delta I=I_1-I_2$ to substantially zero independent of variation or fluctuation of the impedances $Z_1$ and $Z_2$ (and also the inductors $LB_1$ and $LB_2$). In this case, almost all the magnetic fluxes generated in the balance coil $BC_1$ by the currents $I_1$ and $I_2$ are caused to cancel out each other, and therefore the impedance of the balance coil BC1 itself at operation can be regarded as substantially zero. The same current equilibration is performed at the balance coils in the other balance inductance elements $BI_2$ to $BI_{n-1}$ thereby equalizing currents flowing in the primary side wirings of the inverter transformers $TR_1$ to $TR_n$.

On the other hand, the inductors $LB_1$ and $LB_2$ of the balance inductance element $BI_1$ function as a ballast impedance element to stabilize lamp currents of the discharge lamps $La_1$ and $La_2$. For example, when the lamp current of the discharge lamp $La_1$ (hereinafter referred to as "secondary side current" as appropriate) is increased for some reason, the current flowing in the primary winding Np1 (hereinafter referred to as "primary side current" as appropriate) is caused to increase also, wherein since the voltage applied by the inverter means 12 is constant, and since the impedance of the balance coil $BC_1$ is regarded as zero as described above, the impedance due to the inductance of the inductor $LB_1$ acts to decrease the primary side current, which results in suppressing the increase of the secondary side current. And, when the secondary side current is decreased, the primary side current is caused to decrease also, and the impedance due to the inductance of the inductor $LB_1$ acts to increase the primary side current resulting in suppressing the decrease of the secondary side current.

The equivalent load resistance seen from the primary side of the inverter transformer $TR_1$ is defined as $R/N^2$ where: N is the winding ratio (secondary winding number/primary winding number) of the inverter transformer $TR_1$; and R is the equivalent resistance of the discharge lamp $La_1$, and so a ballast impedance element must have an impedance value appropriate for $R/N^2$.

Provision of a ballast impedance element at the primary side of an inverter transformer eliminates the necessity of using a high withstand voltage element and accordingly allows an inductor, which is lower in power loss than a resistor, to be used favorably as a ballast element without paying attention to the consideration that an inductor for high voltage use is inevitably subject to an increase in dimension, which is a drawback of an inductor. In addition, since the load resistance seen from the primary side of an inverter transformer is reduced to about $1/N^2$ as described above, the inductance can be reduced to about $L/N^2$ compared with the case where an inductor functioning equivalently to a ballast element is provided at the secondary side, thus enabling further downsizing of the element. The multiple discharge lamp lighting apparatus 10, if arranged, for example, such that the winding ratio N of the inverter transformer $TR_1$ is set to 100, and that the inductance L of the inductor $LB_1$ is set to about 30 μH, produces a functional capability equivalent to that achieved when an inductor with an inductance L of about 300 mH is provided at the secondary side as a ballast element.

Also, provision of a balance coil at the primary side, rather than at the secondary side, of an inverter transformer eliminates the necessity of using a high withstand voltage element, and an inductance for achieving a practical current equilibration can be reduced, thus enabling downsizing of the element.

In the multiple discharge lamp lighting apparatus 10, a ballast impedance element and a balance coil are integrated into each of the balance inductance elements $BI_1$ to $BI_{n-1}$, whereby the effect and advantage described above can be achieved with a reduced number of components.

For the purpose of showing one of the advantages achieved by providing a ballast impedance element at the primary side, description will now be made on how the multiple discharge lamp lighting apparatus 10 operates when a short circuit in a winding (what is called "layer short") is caused at the secondary side of the inverter transformers $TR_1$ to $TR_n$.

In a conventional multiple discharge lamp lighting apparatus, when a layer short is caused at the secondary winding of any one of inverter transformers, a resistor $r_s$ at the area of the secondary winding having a short circuit becomes connected to the secondary side thus causing an excessive current to flow in the inverter transformers and possibly prompting fuming and firing hazard. At this time, the power loss at the short circuit is represented as:

$$P=Vp^2/rp$$

where Vp is the voltage at the primary side of the inverter transformer, and rp is the load resistance due to a layer short seen from the primary side. On the other hand, in the multiple discharge lamp lighting apparatus 10 according to the present embodiment, if a layer short occurs, for example, in the secondary winding Ns1 of the inverter transformer $TR_1$, the power loss at the short circuit area is represented as:

$$P=rp\cdot Vp^2/((\omega L)^2+rp^2)$$

where L is the inductance of the inductor $LB_1$, which shows that the power loss, that is to say heat generation due to an excessive current, is reduced by the impedance of the inductor $LB_1$.

Also, the inductors $LB_1$ and $LB_2$ function as s low pass filter and are adapted to reject the harmonic component of the output voltage of the inverter means 12 thereby making the waveform of the voltage applied to the primary windings Np1 and Np2 into a substantially sinusoidal waveform. Accordingly, the inverter transformers $TR_1$ and $TR_2$ are denoised and also suppressed from suffering heat generation caused due to the harmonic component.

Further, the inverter means 12 is a high efficiency separately excited circuit including the full bridge circuit 13 and the control circuit 21, wherein the full bridge circuit 13 is driven by the control circuit 21 at a predetermined frequency. Accordingly, unlike, for example, a Royer circuit in which a driving frequency for an inverter means is determined by the resonance frequency of an LC resonance circuit provided at the primary side of an inverter transformer, an element having an impedance and suitable as a ballast can be provided at the primary side without giving consideration to the impact on a resonance frequency.

Figure 5:
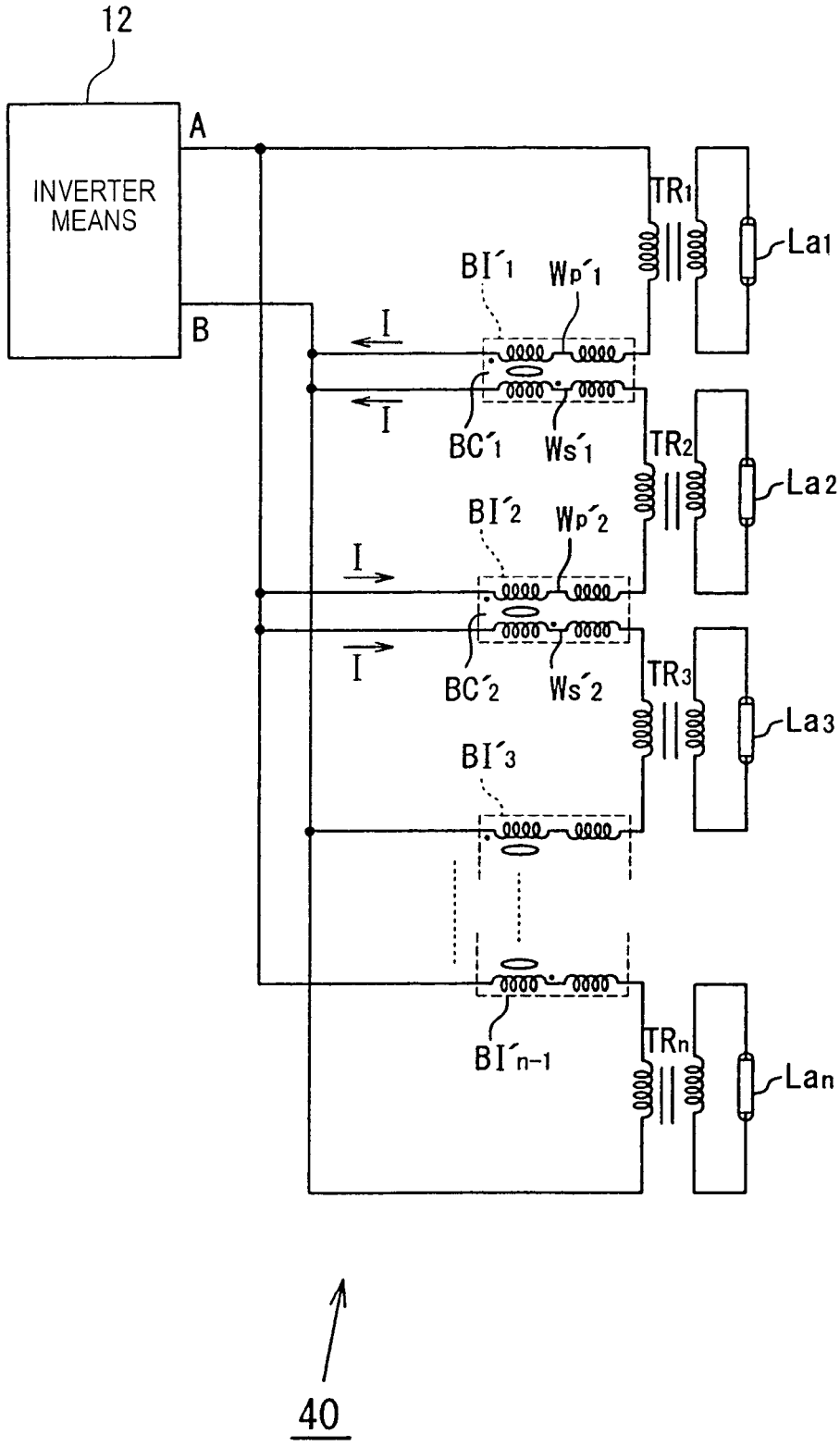
FIG. 5 is a circuit diagram of a multiple discharge lamp lighting apparatus according to a second embodiment of the present invention.

A second embodiment of the present invention will be described with reference to FIG. 5. In explaining the second embodiment, any component parts corresponding to those in FIG. 1 are denoted by the same reference numerals, and redundant explanations will be omitted below. Referring to FIG. 5, a multiple discharge lamp lighting apparatus 40 according to the second embodiment differs from the multiple discharge lamp lighting apparatus 10 of FIG. 1 in that a balance coil $BC'_i$ of a balance inductance element $BI'_i$ (i=1, 2, . . . n−1) joins respective one primary side wirings of two adjacent inverter transformers $TR_i$ and $TR_{i+1}$, where the respective one primary side wirings are connected to a same terminal (either A or B) of the inverter means 12. Specifically, for example, a balance coil $BC'_1$ joins respective one primary side wirings of two adjacent inverter transformers $TR_1$ and $TR_2$, the respective one primary side windings being connected to the output terminal B of the inverter means 12, and a balance coil $BC'_2$ joins respective one primary side wirings of two adjacent inverter transformers $TR_2$ and $TR_3$, the respective one primary side windings being connected to the output terminal A of the inverter means 12. In the arrangement described above, since a common mode current I is caused to flow in primary and secondary winding Wp'i and Ws'i of a balance inductance element $BI'_i$, a balance coil $BC'_i$ of the balance inductance element $BI'_i$ has a polarity opposite to that of the balance coil $BC_1$ of the balance inductance element BI1 of FIG. 3(*b*). With such a structure, the multiple discharge lamp lighting apparatus 40 achieves the same effect and advantage as the multiple discharge lamp lighting apparatus 10 according to the first embodiment. In this connection, the primary and secondary windings Wp'i and Ws'i of the balance inductance element $BI'_i$ may be structured such that one coil wound around a magnetic core of an open magnetic circuit is split by an intermediate tap.

The present invention is not limited in structure to the multiple discharge lamp lighting apparatuses 10 and 40 described above, and some constituent elements may be provided additionally.

Figure 6:
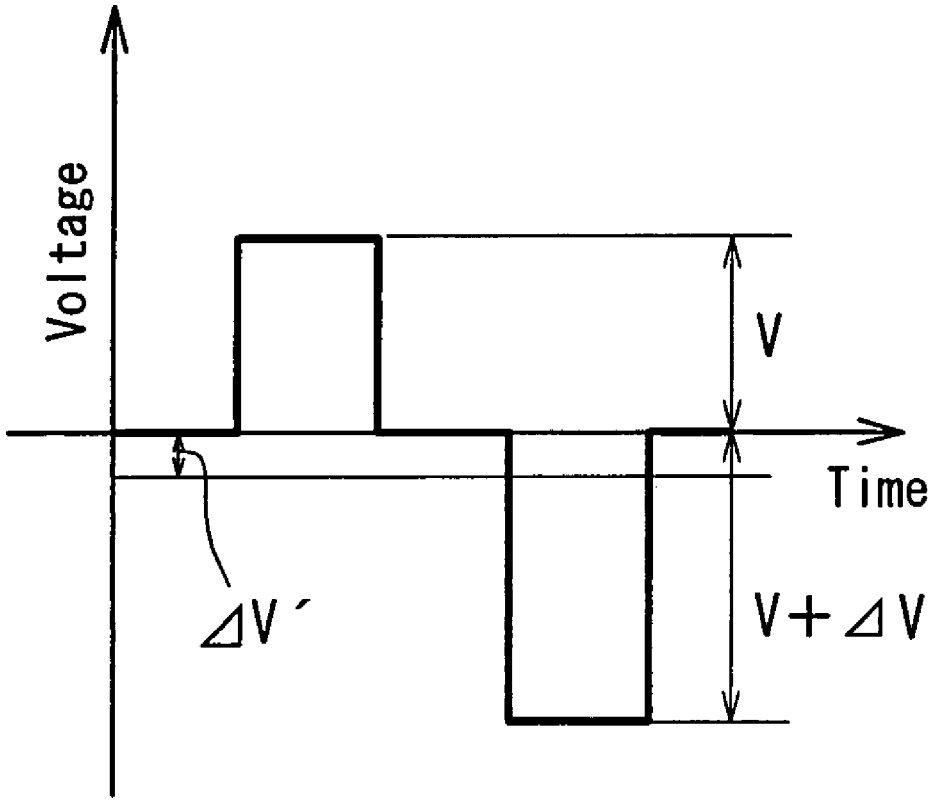
FIG. 6 is a schematic graph of an asymmetric voltage waveform of an inverter means.

For example, a capacitor may be connected in series between the inverter means 12 and each of the primary windings Np1 to Npn of the inverter transformers $TR_1$ to $TR_n$. When the inverter means 12 involves an asymmetric output waveform having a voltage V in one direction and a voltage V+ΔV in the other direction as shown in FIG. 6, a DC voltage with an average voltage of ΔV' (ΔV' is the time averaged voltage of ΔV) is superposed to the output voltage. Under the circumstances described above, if the ballast impedance element is composed of an inductor alone, a large DC current is superposed to the inverter transformers $TR_1$ to $TR_n$, which causes magnetic saturation and efficiency deterioration. In such a case, the DC component of the asymmetric voltage waveform can be cut by providing a capacitor connected in series between the inverter means 12 and the ballast impedance element, and the symmetry of the voltage applied to the primary winding of the inverter transformer TR is improved.

Also, a capacitor may be connected in parallel to each of the primary windings Np1 to Npn of the inverter transformers $TR_1$ to $TR_n$, whereby the resonance frequency of a resonance circuit at the secondary side is regulated so as to stabilize a lamp current, and at the same time the harmonic component of the output voltage of the inverter means 12 is more effectively rejected so that the waveform of the voltage applied to the primary windings Np1 to Npn can be made into a substantially sinusoidal waveform.

What is claimed is:

1. A multiple discharge lamp lighting apparatus to drive a plurality of discharge lamps, the apparatus comprising:

an inverter means comprising a switch means and functioning to output a high frequency voltage;

a plurality of inverter transformers each having a primary winding thereof connected in parallel with the switch means and having a discharge lamp connected at a secondary winding thereof; and a plurality of balance inductance elements each of which comprises a magnetic core provided with a gap, and a pair of windings disposed around the magnetic core where a tight coupling section and a loose coupling section are formed, and each of which is disposed between two adjacent inverter transformers such that one of the pair of windings is connected between one of two output terminals of the switch means and a terminal of the primary winding of one of the two adjacent inverter transformers, and another of the pair of windings is connected between another output terminal of the switch means and a terminal of the primary winding of another of the two adjacent inverter transformers, wherein the tight coupling section and the loose coupling section of each balance inductance element are constituted respectively by a tight coupling section and a loose coupling section of the pair of windings disposed around the magnetic core with a gap forming an open magnetic path such that the loose coupling section is located toward a gapped portion of the magnetic core where the pair of windings are loosely coupled to each other and the tight coupling portion is located toward a portion of the magnetic core opposite to the gapped portion where the pair of windings are tightly coupled to each other, and wherein the pair of windings are connected in series to respective primary side wirings of the two adjacent inverter transformers, whereby the balance inductance elements each function as an element which is composed such that a balance coil formed by the tight coupling section is connected in series to each of impedance elements formed respectively at the pair of windings by means of leakage inductance generated at the loose coupling section.

* * * * *